US005624049A

United States Patent [19]

Kovash et al.

[11] Patent Number: 5,624,049

[45] Date of Patent: Apr. 29, 1997

[54] INTERMODAL CONTAINER WITH INNER RECEPTACLE

[75] Inventors: Dean Kovash, Manning; Bill Reiter; Tom Knutson, both of Dickinson, all of N. Dak.

[73] Assignee: WasteCo Manufacturing, Dickinson, N. Dak.

[21] Appl. No.: 567,673

[22] Filed: Dec. 5, 1995

[51] Int. Cl.[6] ..... B65D 88/26

[52] U.S. Cl. ..... 220/1.5; 220/646; 220/650

[58] Field of Search ..... 220/1.5, 646, 669, 220/650, 565, 588

[56] References Cited

U.S. PATENT DOCUMENTS

| | | | |
|---|---|---|---|
| D. 244,092 | 4/1977 | Mowatt-Larssen et al. | D23/1 |
| 1,388,250 | 8/1921 | Godfrey . | |
| 2,863,797 | 12/1958 | Meyer | 154/83 |
| 2,910,322 | 10/1959 | Magor | 296/28 |
| 3,652,123 | 3/1972 | Speers | 296/28 D |
| 3,895,842 | 7/1975 | Fair | 298/1 R |
| 3,897,882 | 8/1975 | Budoff | 214/517 |
| 3,938,689 | 2/1976 | de Munnik | 220/646 |
| 3,971,491 | 7/1976 | Mowatt-Larssen et al. | 220/71 |
| 4,029,354 | 6/1977 | Valeri | 295/28 D |
| 4,094,430 | 6/1978 | Cauley | 220/646 |
| 4,181,237 | 1/1980 | Kenyon et al. | 220/646 |
| 4,323,279 | 4/1982 | Domes et al. | 298/23 DF |
| 4,474,404 | 10/1984 | Hagenbuch | 296/184 |
| 4,575,146 | 3/1986 | Markos | 296/39 R |
| 4,645,405 | 2/1987 | Cambiano | 414/494 |
| 4,844,336 | 7/1989 | Huber et al. | 237/12.3 R |
| 4,905,854 | 3/1990 | Gerhard | 220/1.5 |
| 4,979,866 | 12/1990 | Croy | 414/517 |
| 5,022,546 | 6/1991 | Bock | 220/4.03 |
| 5,033,640 | 7/1991 | Holtz | 220/646 |
| 5,078,560 | 1/1992 | Patrick et al. | 410/68 |
| 5,085,448 | 2/1992 | Shubin | 280/33.998 |
| 5,090,773 | 2/1992 | Guillaume | 298/17 R |
| 5,110,005 | 5/1992 | Schilling | 220/404 |
| 5,163,572 | 11/1992 | Gerhard | 220/1.5 |
| 5,167,341 | 12/1992 | Morton et al. | 220/346 |
| 5,178,292 | 1/1993 | Korzeniowski | 220/1.5 |
| 5,207,472 | 5/1993 | Gower | 296/39.2 |
| 5,230,433 | 7/1993 | Hamilton et al. | 215/221 |
| 5,238,357 | 8/1993 | Patrick et al. | 414/420 |
| 5,273,390 | 12/1993 | Crissman | 414/513 |
| 5,284,266 | 2/1994 | Januel et al. | 220/1.5 |
| 5,362,198 | 11/1994 | Patrick | 414/786 |

FOREIGN PATENT DOCUMENTS

| | | |
|---|---|---|
| 670903 | 9/1963 | Canada . |
| 2209139 | 5/1989 | United Kingdom . |

OTHER PUBLICATIONS

"Closed Van–Type Dry Cargo Containers for Domestic Conatiner–On–Flat Car (COFC) Service", *Association of American Railroads, Mechanical Division, Manual of Standards and Recommended Practices*, Specification M–930–90, 17 pgs (1990).

*Primary Examiner*—Joseph M. Moy
*Attorney, Agent, or Firm*—Mueting, Raasch, Gebhardt & Schwappach, P.A.

[57] ABSTRACT

An intermodal container having a non-metallic tuner receptacle in an external frame, where the inner receptacle has a bottom wall and side walls formed of a one-piece, completely integral sheet.

20 Claims, 6 Drawing Sheets

INTERMODAL CONTAINER WITH INNER RECEPTACLE

FIELD OF THE INVENTION

The present invention relates to the field of intermodal containers for transporting goods and materials. More particularly, the present invention relates to intermodal container having a non-metallic inner receptacle in an external frame.

BACKGROUND OF THE INVENTION

Intermodal containers are used to transport goods and materials using a variety of transportation means including rail, highway and/or marine shipping. Intermodal containers are manufactured to standard dimensions to allow shippers to stack and load intermodal containers manufactured by different companies in the same loads without concern tier compatibility between the intermodal containers.

One particular type of intermodal transportation system is commonly referred to as a "Container-On-Flat-Car" (COFC) system. In this system, containers are provided that can carry goods on trucks or on rail cars. In addition, the containers are also adaptable for use in marine shipping.

One specification liar intermodal containers manufactured for COFC systems is promulgated by the Mechanical Division of the Association of American Railroads. Its Specification M-930-90. Revised 1990, titled "Closed Van-Type Dry Cargo Containers for Domestic Container-On-Flat-Car (COFC) Service" which is hereby incorporated by reference, recites detailed requirements relating to dimensions of the COFC containers, their load capacities, strength requirements. The document also sets forth testing protocol for determining whether the intermodal containers meet the requirements.

Another intermodal system is commonly referred to as "Trailer-On-Flat-Car" (TOFC) and typically involves containers adapted to be placed on flatbed railway cars. In this system, truck trailers are themselves loaded on the rail cars and then removed close to their destination where they are then hauled the remaining distance over the roads.

As used in connection with the present invention, the term "intermodal container" is meant to include any container designed for transporting large amounts of goods or bulk materials via a variety of transportation modes, including truck, rail and/or marine shipping. The containers further are able to be moved between shipping modes without unloading or loading their contents. Further, the intermodal containers may be open-topped or they may be completely enclosed depending on the nature of the materials to be hauled and the protection desired. As such, the containers of both of the systems, COFC and TOFC are included within this definition, as are other containers used in other intermodal systems.

Intermodal containers are typically manufactured using sheet metal (typically steel or aluminum) attached to a framework of structural members. As a result, they are themselves typically relatively heavy which limits the loads which can be transported by the containers. Furthermore, the metal used to manufacture the intermodal containers typically corrodes easily, reducing the useful life of the containers. In addition, it may not be desirable or allowable to allow some goods or materials to come into contact with the metal, thereby requiring additional packaging of the goods or materials to prevent contact with the metal of the containers.

Furthermore, where bulk materials such as grain, coal, or even waste materials are being transported, the metal lining the containers makes unloading difficult in many situations. For example, in colder climates moisture in the materials may cause them to freeze to the interior of the container, typically requiring hand labor to dislodge the material. In some situations, the entire container may be heated to facilitate unloading and/or pressurized water may be required to completely unload the container All of these actions raise the cost of transporting materials. In addition, the use of water to clean the containers raises containment and contamination issues at the locale where the containers are unloaded.

Friction between the materials and the container can also make unloading difficult, requiring the operator, in some situations, to rapidly accelerate and decelerate the containers in an attempt to jar the materials loose. Such actions add unnecessary stress and wear to the containers as well as the handling equipment, adding the cost to repair any damage and potentially reducing the useful life of the containers and/or handling equipment.

SUMMARY OF THE INVENTION

The present invention provides an intermodal container having a non-metallic inner receptacle in an external frame, where the inner receptacle has a bottom wall and side walls formed of a one-piece, completely integral sheet.

One advantage of intermodal containers according to the present invention that the preferred containers are manufactured with a polyethylene or similar inner receptacle having a bottom wall and side walls formed of a one-piece, completely integral sheet. As a result, the material in the intermodal container is easily removed due to the high-release, low friction surface of the inner receptacle. In most cases, merely elevating one end of the container will cause the materials in the container to slide out without clinging to the walls of the inner receptacle. If desired, low pressure water (i.e., at residential pressure levels) can be used to clean the interior of the containers.

Another advantage of intermodal containers according to the present invention is that the inner receptacle preferably resists corrosion from moisture and a large number of chemicals.

Another potential advantage of the present invention is that it provides an intermodal container that meets all of the requirements for such containers, yet intermodal containers according to the present invention can weigh less than typical intermodal containers manufactured with sheet metal walls. As a result, the vehicles transporting intermodal containers according to the present invention may be able to haul additional cargo or reduce the fees, tariffs or taxes paid based on weight.

These and other features and advantages of intermodal containers according to the present invention will be apparent upon reading the following detailed description of the invention and the appended claims.

DETAILED DESCRIPTION OF THE PREFERRED EMBODIMENTS

Figure 1:
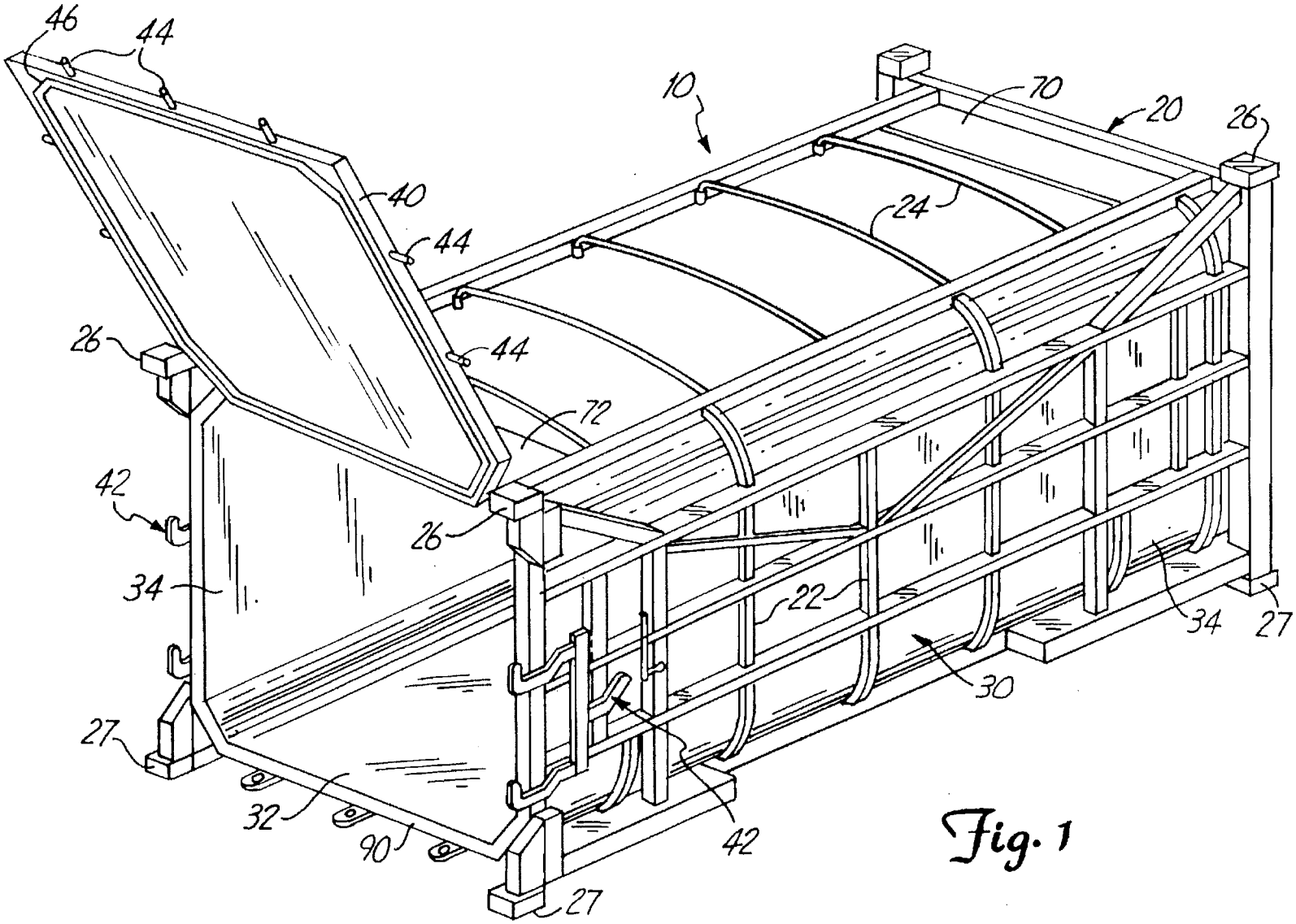
FIG. 1 is a rear perspective view of one intermodal container according to the present invention.
Figure 2:
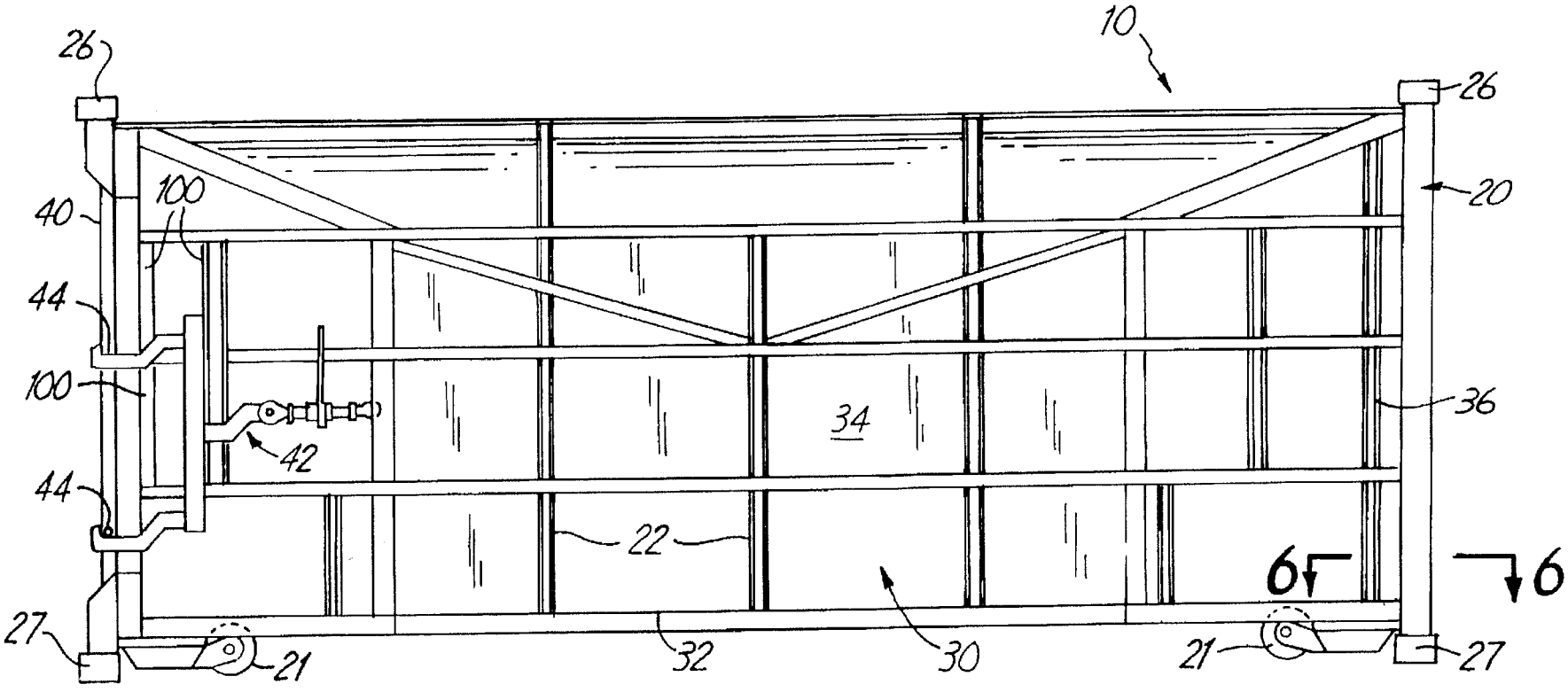
FIG 2 is a side view of the intermodal container of FIG. 1 with the rear door closed.

FIGS. 1 and 2 depict one intermodal container 10 according to the present invention. The intermodal container 10 is designed for a COFC intermodal system. As shown the intermodal container 10 includes an external frame 20 in which a substantially rigid inner receptacle 30 is located. The inner receptacle 30 forms a bottom wall 32, a pair of side walls 34 and a front wall 36, all of which are surrounded by spaced apart frame members 22.

Because inner receptacle 30 possesses sufficient rigidity and burst strength, the frame members 22 can be spaced apart as depicted but still offer adequate support to the inner receptacle 30 to contain materials within container 10 during transit as well as loading/unloading. It is preferred that the spacing of frame members along the bottom wall 32 is closer than along the side walls 34 due to the increased stresses encountered there. In the preferred embodiment, the members 22 are formed of steel tubing and channels, although other materials may be substituted for the preferred steel.

The preferred frame 20 includes a pair of retractable rollers 21 (best seen in FIG. 2) at the front and rear of the container 10 to assist in moving the containers when they are not fixed in place. Such rollers are found on many intermodal containers and will not be described in detail herein.

The side walls 34 and bottom wall 32 of the container 10 define a rear opening use lid for loading and unloading of the container 10, particularly where loading through the open top of the container 10 is impractical or unfeasible. To close the rear opening, the intermodal container 10 includes a door 40 connected to the frame 20 by hinges along its top edge. Alternatively, the door 40 could be hinged at either side or along the bottom, depending on the requirements for loading and unloading. In some instances, door 40 may not be hinged to the frame 20 at all.

Door 40 is retained in a closed position by latches 42 located on both of the side walls 34 as well as along the bottom wall 32. The latches cooperate with pins 44 protruding from the edges of the door 40 to retain it in place against the rear opening of the intermodal container 10. The particular latch mechanisms used can be any of the known latches used on existing intermodal container containers or any other suitable latches provided they retain the door 40 in the closed position when desired and do not interfere with opening and closing of the door 40 or loading of the intermodal container 10.

The sides of the frame 20 include curved members 22 designed to hold the side walls 34 of the inner receptacle 30 in a curved configuration as shown in FIG. 1. The preferred radius of curvature for the curved members 22 is about 17", although it will be understood that the radius of curvature could change based on the thickness of the materials used for the inner receptacle 30 and other factors.

The intermodal container 10 shown includes an open top spanned by a plurality of members 24 designed to support a tarp (not shown) or other removable cover for intermodal container 10.

The frame 20 of the intermodal container also includes four top corner fittings 26 designed for hoisting and securing the intermodal container 10 on a rail car, truck trailer or in the hold or on the deck of a ship. Four bottom corner fittings 27 designed for hoisting and securing the intermodal container 10 on a rail car, truck trailer or in the hold or on the deck of a ship are located at the bottom corners of the frame 20.

The bottom wall 32 and side walls 34 of the inner receptacle 30 are preferably formed from a one-piece, completely integral sheet of non-metallic material. In the preferred embodiment, the inner receptacle 30 is formed of high molecular weight polyethylene (HMWPE) containing a black colorant and 5%by weight of erucamide. The erucamide is an antistatic/release-enhancing agent that reduces static buildup between the inner receptacle 30 and any contents in the receptacle, as well as improving the release properties of the material to facilitate unloading of the container 10.

Although HMWPE is preferred, those skilled in the art will understand that any polyolefin or other non-metallic material having the properties necessary to form an inner receptacle in an intermodal container according to the present invention could be substituted for the preferred material. Those properties include sufficient rigidity, burst strength, chemical resistance, and a high-release, low friction surface similar to the properties of the preferred HMWPE.

Furthermore, although the entire inner receptacle 30 of the preferred embodiment is formed of HMWPE, it may be possible to provide different portions of the inner receptacle 30 of different materials. For example, the front wall 36 of the inner receptacle 30 may be provided of another suitable material such as another polyolefin provided that the different material can be adequately attached to the bottom wall 32 and side walls 34 of the remainder of the inner receptacle 30.

Figure 3:
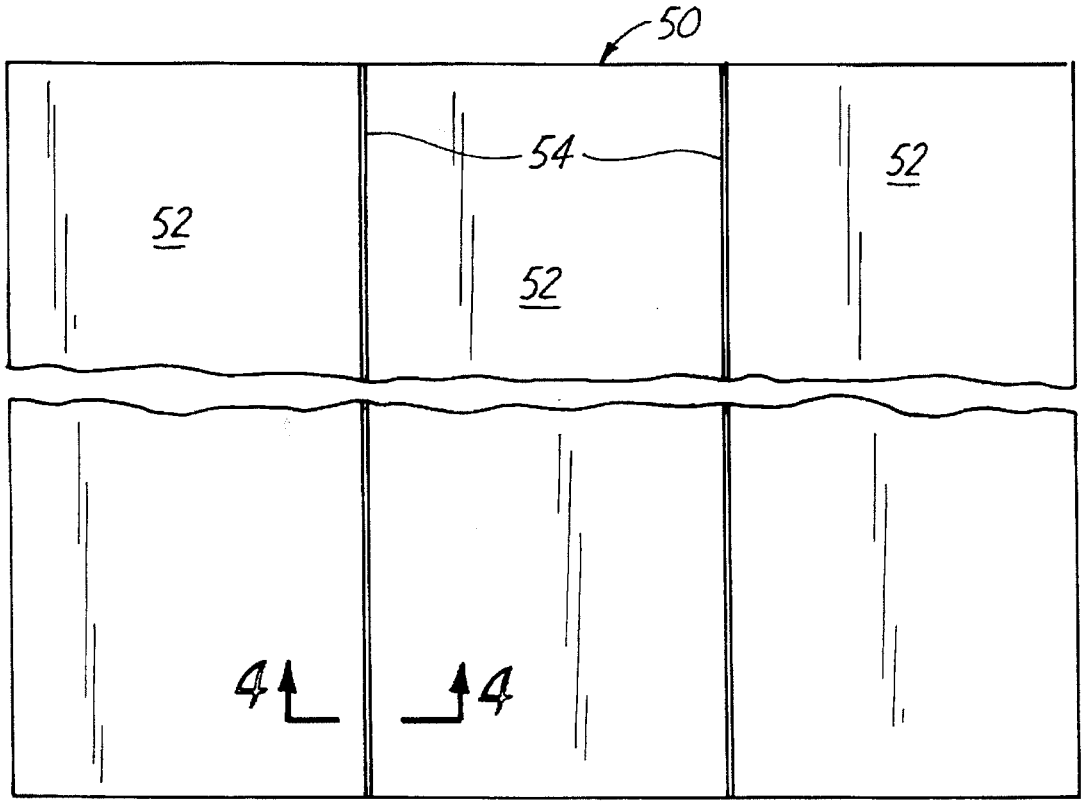
FIG. 3 is a plan view of the sheet used to form the bottom wall and side walls of the inner receptacle used in the intermodal container of FIG. 1.

FIG. 3 is a plan view of that sheet 50 which is actually a composite formed by welding three panels 52 of HMWPE together along weld lines 54. Each of the individual panels in the depicted embodiment is 75⅜"×238". When connected to form the one-piece, completely integral sheet 50, the panels 52 form a sheet 50 that is 226⅛"×238". These dimensions can, of course, be altered depending on the size of the intermodal container 10 to be constructed.

Figure 4:
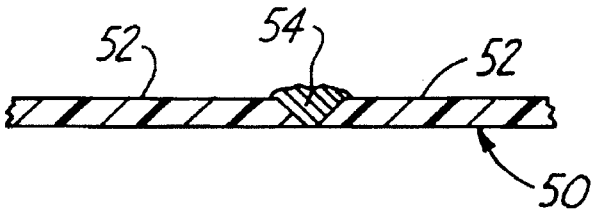
FIG. 4 is an enlarged cross-sectional view taken along line 4—4 in FIG. 3.

FIG. 4 is an enlarged cross-sectional view of one of the welds 54 used to connect panels 52. As shown, the abutting edges of the panels 52 are beveled to an angle of about 45° before welding. Before welding the areas to be affected are buffered with an 80 grit sanding disc to eliminate any impurities at or just below the surface in the area of the weld. The welds are formed using a plastic extrusion welder such as a Munsch U7-R Extrusion Welder available from Columbine International Ltd., Placeryille, Calif. The machine is set to produce an extrusion temperature of about 425° F. (±5°) and a preheat air temperature of about 545° F. (±5°) for the preferred HMWPE material. Optimal weld strengths formed under these conditions are about 93% of the strength of an unwelded section of the preferred HMWPE materials.

After the sheet 50 is formed, it is inserted into the frame 20 and cold-forms to the shape of the frame 20. To assist in cold-forming, a bar or rod can be located on the bottom of the frame 20 before the sheet 50 is lowered into the frame 20. After the sheet 50 contacts the bottom of the frame 20, the rod or bar is then raised such that the sheet 50 forms a "W" (as seen from the end) within the frame 20. By raising the center of the sheet 50, its edges are allowed to fall into place within frame 20 after which the bar or rod can be lowered, allowing the sheet 50 to lie against the bottom of the frame 20.

Although the sheet 50 is inserted into the frame 20 and cold-formed to conform to the frame 20, it is envisioned that in some instances it may be useful to use heat, vibration, ultrasonic energy or other means to assist in forming the inner receptacle 30 within frame 20.

Also, although the embodiment depicted in the figures and described here has an open top, intermodal containers according to the present invention can also be manufactured that are completely enclosed. In such a design, the sheet 50 would preferably be formed with a sufficient width such that a single weld (similar to welds 54 used to form sheet 50) would be located along the top of the inner receptacle and extend along its length to seal the top of the inner receptacle. As a result, sheet 50 would essentially form an enclosed tube located within a frame. Alternatively, the top of the inner receptacle 30 could be enclosed by attaching a separate sheet of material to the top edges of the side walls 34 and the front wall 36.

Figure 5:
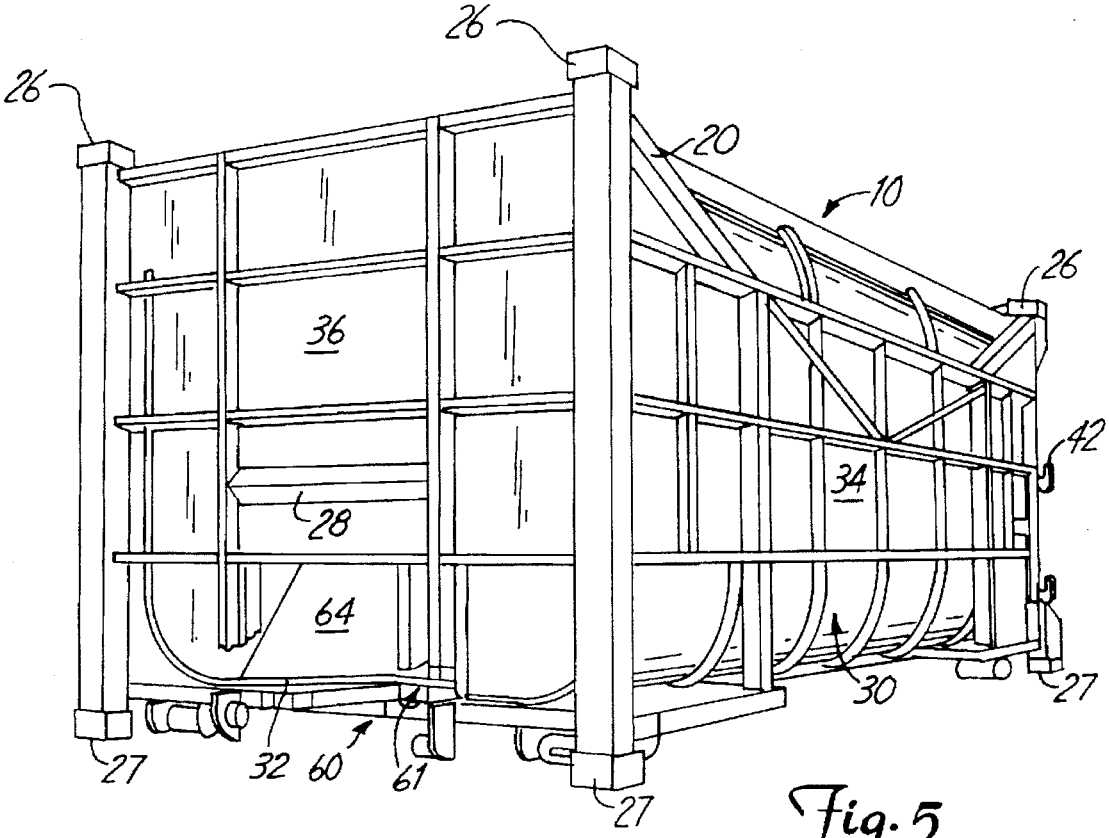
FIG. 5 is a front perspective view of the intermodal container of FIG. 1, with the rear door in the closed position.
Figure 6:
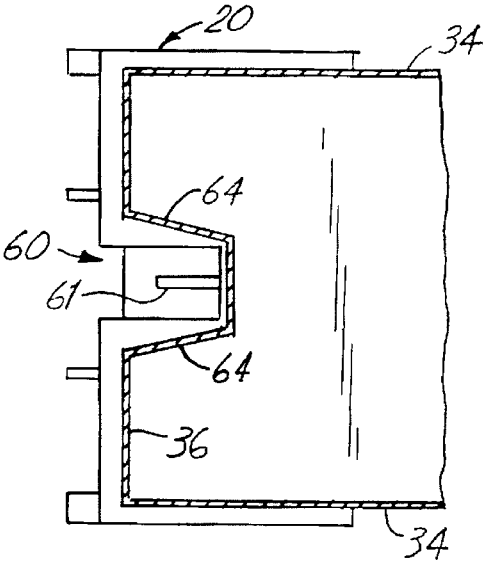
FIG. 6 is a cross-sectional view of the front of the container taken along line 6—6 in FIG. 2.
Figure 5A:
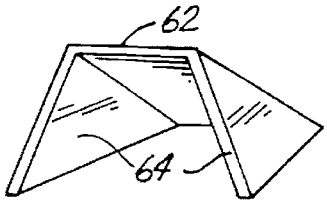
FIG. 5*a* is a perspective view of a doghouse used in connection with the container of FIG. 1.

The front wall 36 of the inner receptacle 30 is preferably formed from a single panel of the preferred ⅜" HMWPE material. As best seen in FIGS. 5, 5*a* and 6, a "doghouse" 60 is provided in the front of the depicted embodiment of the intermodal container 10 to allow a place for a hook 61 used to attach a cable to the intermodal container 10 for loading using a cable and winch or similar method.

Figure 7:
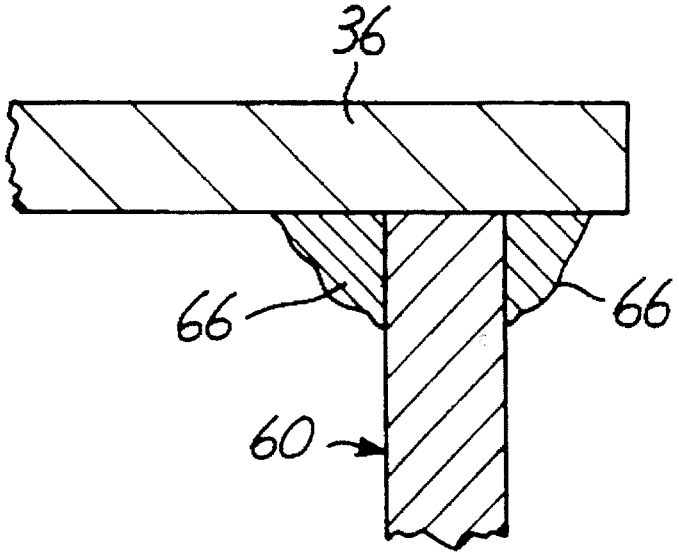
FIG. 7 is an enlarged cross-section of a Tee-joint used in connection with the inner receptacle for the container of FIG. 1.

The preferred doghouse 60 is formed from the preferred ⅜" HMWPE material and includes a top section 62 and two sides 64 (best seen in FIG. 5*a*). The edges of the doghouse 60 are welded to the front wall 36 using a Tee-joint with fillets 66 on both sides of the joint that extend for the entire length of the joint. An enlarged cross-section of one such Tee-joint is depicted in FIG. 7. As shown there, it is preferred that the panels forming the doghouse 60 are set back from the edge of the cutout formed in the front wall 36 to allow for the fillet 66 on both sides of the joint. The same weld parameters and processes described for welds 54 in sheet 50 are followed for these welds as well.

In the most preferred embodiment, the doghouse 60 is formed from a single piece of ⅜" HMWPE that is thermoformed to the desired shape using a conventional plastic and forming bar designed for plastics (McMaster No. 2370A22 and optional sword).

After forming the doghouse 60, it is welded to the HMWPE material forming the front wall 36. That assembly, i.e., the front wall 36 and doghouse 60 are then located in the side walls 34 and bottom wall 32 which are already located within frame 20. The front wall 36 and doghouse 60 are then welded to the bottom wall 32 and side walls 34 using the same Tee-joint described above for the joint between the doghouse 60 and the front wall 36. In other words, the front wall 36 is actually inset about 1" into the body of the inner receptacle 30 to allow for weld fillets on both sides of the joint.

FIG. 5 also depicts a push plate 28 attached to the front portion of the frame 20. The push plate 28 is useful for moving the container 10 without damaging the front wall 36 of the inner receptacle 30.

A pair of splash shields 70 and 72 (best seen in FIG. 1) are also provided of the preferred ⅜" HMWPE material. Splash shield 70 is welded along the top edge of the front wall 36 and along the top edges of the side walls 34. Splash shield 72 is welded at the rear opening of the container 10 to the top edges of the side walls 34. Both splash shields 70 and 72 are welded to the side walls 34 using a beveled weld similar to welds 54 used to form sheet 50. The preferred width of the splash shields is about 12", although that dimension can be varied.

At the rear opening of the container, the rearmost edge of the splash shield 72 is welded along its entire length to the seal channel 90, which is described more completely below.

By providing the splash shields 70 and 72, the container 10 can be tilted from front to back with a reduced chance for spillage of the materials inside the container 10.

Figure 8:
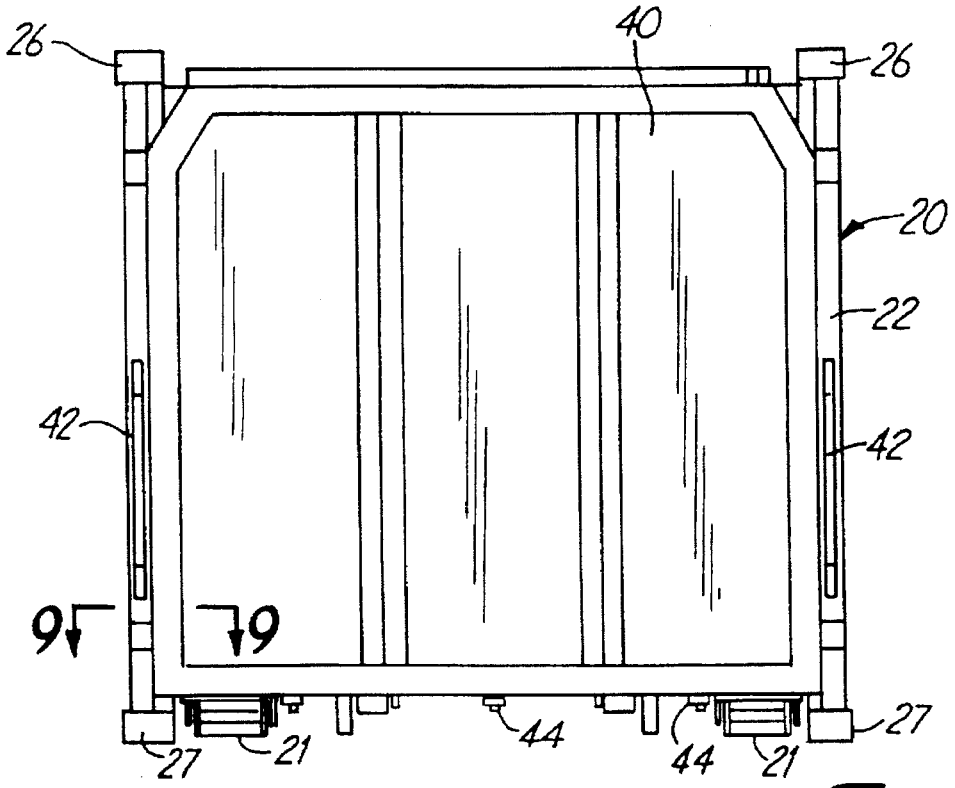
FIG. 8 is an end view from the rear of the intermodal container of FIG. 1 with the door in the closed position.
Figure 9:
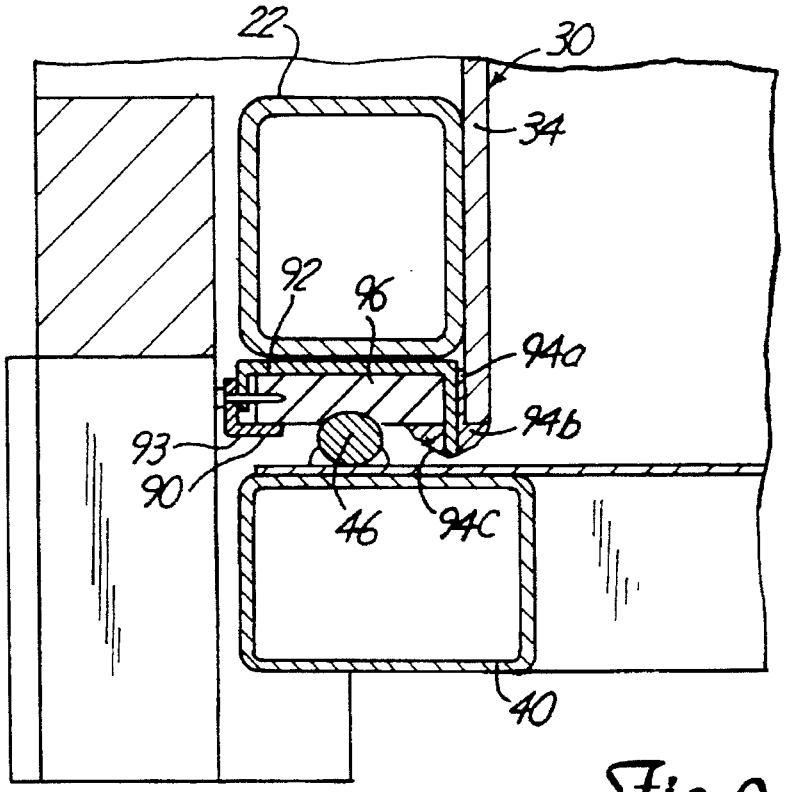
FIG. 9 is an enlarged cross-sectional view of one seal between the rear door and rear opening in the intermodal container of FIG. 1, taken along line 9—9 in FIG. 3.

Turning now to FIGS. 8 and 9, the rear door 40 of the depicted embodiment of the container 10 and the mechanism by which the door 40 and inner receptacle 30 are sealed together will be described. The door 40 is formed of structural members connected to form a framework to which sheet metal is attached facing the interior of the container 10 (when the door 40 is closed).

A rod 46 is attached to the interior of the door 40, with the rod forming a closed loop as seen in FIG. 1. The rod 46 is preferably formed of ⅞" diameter steel although any other suitable materials and/or dimensions could be substituted.

In the depicted embodiment, the sheet metal of door 40 is exposed to the materials in the container 10. If it is not allowable or desirable to allow those materials to contact a metal surface, the door 40 could be lined with a sheet of the preferred HMWPE material or other suitable non-metallic material. That material could be attached directly to the framework used on depicted door 40 in place of the sheet metal (although additional bracing may be necessary) or it could be attached to the sheet metal of the door 40 using adhesives or mechanical fasteners.

Likewise, the rods 46 could also be provided of a non-metallic material or they could be formed integral with the sheet of non-metallic material used to line door 40. In some instances, it may be desirable to provide rods 46 of a coated steel where the compressive strength of a steel or other metal core is desired.

The preferred inner receptacle 30 is provided with a seal channel 90 attached to the rear opening of the inner receptacle 30. The seal channel 90 can be seen generally in FIG. 1 and is shown in an enlarged cross-sectional view in FIG. 9.

One preferred seal channel 90 is formed of two thermoformed pieces of 3/16" HMWPE material that are mitered and welded together to form the desired shape. The larger piece forms a C-channel 92 and the smaller piece is an angle 93. The C-channel 92 is welded to either the bottom wall 32, side walls 34 or splash shield 72 at three places 94*a*, 94*b* and 94*c* as depicted in FIG. 9. The welds 94*a–c* are performed according to the standards set forth above.

A sealing material or gasket 96 is located within C-channel 92 and the gasket 96 preferably deforms slightly to conform to the shape of the rod 46 on door 40 to seal the door 40 against the rear opening of the inner receptacle 30. The preferred gasket exhibits elastomeric characteristics to allow repeated sealing and unsealing of the door 40 and inner receptacle 30. Angle 93 is attached to the outer perimeter of C-channel 92 using any suitable fastening method. The depicted method includes threaded fasteners which also serve to assist in retaining the gasket 96 in C-channel 92. Weld 94*c* also assists in retaining the gasket 96 in C-channel 92 in the depicted embodiment.

To prevent movement of the inner receptacle 30 between the front and rear of the frame 20, the position of the inner receptacle 30 relative to the frame 20 is fixed near the rear opening of the container 10. The inner receptacle 30 is fixed relative to the frame only near the rear of the container 10 because of the different rates of expansion between the inner receptacle 30 and the frame 20. By fixing the position of the inner receptacle 30 near the rear, the location of the rear opening of the inner receptacle 30 relative to the frame 20 is maintained substantially constant which prevents problems with operation of the door 40 and sealing between the door 40 and the seal channel 90. The remainder of the inner receptacle 30, i.e., the front portion is allowed to "float" as the inner receptacle 30 expands and contracts due to temperature variations.

In the preferred embodiment, the fixing of the inner receptacle 30 position in the frame 20 is accomplished by a set of anchor blocks 100 located around the perimeter of the inner receptacle 30 proximate the rear opening of the container 10. The anchor blocks 100 are preferably located on both side walls 34 (see FIG. 2) and the bottom wall 32 and abut members of the frame 20 in a manner that prevents movement in either direction (front or rear). In the preferred embodiment of container 10, it has been found that providing about six lineal feet (as measured about the perimeter of the inner receptacle 30) of the preferred anchor blocks 100 is sufficient to fix the inner receptacle 30 in place.

Figure 10:
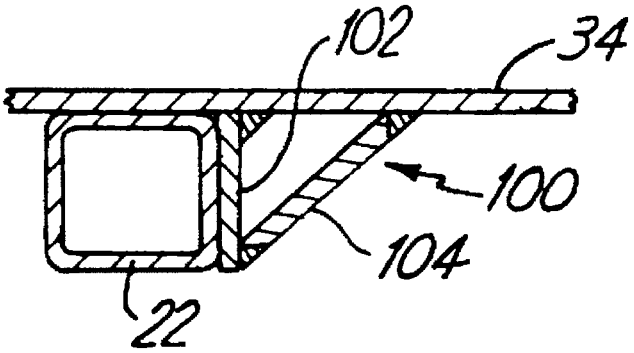
FIG. 10 is an enlarged cross-sectional view of one anchor block for use with intermodal containers according to the present invention.

FIG. 10 is an enlarged cross-sectional view of one preferred construction for the anchor blocks 100. The anchor block 100 is constructed of two strips of ⅜" HMWPE material. The first strip 102 is welded at a right angle to the bottom wall 32 or side wall 34. Strip 102 is preferably located immediately adjacent a member of frame 20. The second strip 104 is beveled along its edges and is welded to the free edge of the first strip 102 and to the bottom wall 32 or side wall 34, thereby bracing the first strip 102 in position. Alternate methods of fixing the location of inner receptacle 30 relative to the frame 20 could, of course, be substituted for the preferred anchor blocks 100 including, but not limited to: adhesives, mechanical fasteners, clamps, etc.

Although various features and advantages of one embodiment of the present invention have been described herein, it will be understood that variations and substitutions can be made which do not fall outside the scope of the invention as defined by the claims appended hereto. Examples of some modifications include the use of a frame 20 that is manufactured out of non-metallic materials such as reinforced plastics or resins or other materials. Likewise, although HMWPE is described as the preferred inner receptacle material, other non-metallic materials may be substituted in its place provided that they can form a one-piece, completely integral body for the inner receptacle 30. Similarly, the depicted frame 20 can be provided in an infinite number of designs according to the structural needs of the user. The seal mechanism used to seal the door 40 to the inner receptacle 30 can also be replaced by any of a number of other seal arrangements known to those skilled in the art.

We claim:

1. An intermodal container comprising:

a) an inner receptacle forming a bottom wall, two side walls, and a front wall of the container, the side walls and bottom wall of the inner receptacle defining a rear opening in the container, the rear opening located opposite the front wall, wherein the bottom wall and the two side walls are formed of a one-piece, completely integral sheet of non-metallic material;

b) a frame located outside of the inner receptacle;

c) a door connected to the frame proximate the rear opening of the container, the door being movable between open and closed positions, wherein in the closed position, the door forms a rear wall of the container;

d) top corner fittings located on each of the upper corners of the frame; and e) bottom corner fittings located on each of the lower corners of the frame.

2. An intermodal container according to claim 1, further comprising an anchor block attached to the outer surface of the inner receptacle proximate the rear opening, the anchor block cooperating with the frame to fix the relative position of the inner receptacle within the frame.

3. An intermodal container according to claim 1, wherein the inner receptacle is formed of a polyolefin.

4. An intermodal container according to claim 1, wherein the inner receptacle is formed of high molecular weight polyethylene.

5. An intermodal container according to claim 1, wherein the sheet is maintained in the proper shape by the frame.

6. An intermodal container according to claim 1, wherein the front wall comprises a substantially planar sheet of non-metallic material.

7. An intermodal container according to claim 1, further comprising a doghouse attached to the front wall of the inner receptacle, the doghouse being formed of a non-metallic material.

8. An intermodal container according to claim 7, wherein the doghouse is formed of a completely integral one piece sheet of non-metallic material.

9. An intermodal container according to claim 1, wherein the bottom wall and the two side walls are formed of a one-piece, completely integral sheet of polyolefin, and further wherein the front wall is formed of a second completely integral sheet of polyolefin, and still further wherein the front wall is welded to the side walls and the bottom wall.

10. An intermodal container according to claim 9, wherein the doghouse is formed of a third completely integral sheet of polyolefin, and further wherein the doghouse is welded to the front wall and the bottom wall of the inner receptacle.

11. An intermodal container according to claim 1, further comprising a top wall connecting the side walls and front wall.

12. An intermodal container according to claim 11, wherein the top wall comprises a tarp.

13. An intermodal container according to claim 11, wherein the top wall is integral with the side walls and the front wall.

14. An intermodal container according to claim 1, further comprising a seal located about the perimeter of the rear opening formed by the inner receptacle, wherein the door and inner receptacle form a sealed container when the door is in the closed position.

15. An intermodal container according to claim 14, wherein the seal comprises a channel formed integral with the inner receptacle, the channel containing a gasket against which the door seals.

16. An intermodal container according to claim 15, wherein the door comprises a protrusion adapted to seal against the gasket.

17. An intermodal container comprising:

a) an inner receptacle forming a bottom wall, two side walls, and a front wall of the container, the side walls and bottom wall of the inner receptacle defining a rear opening in the container, the rear opening located opposite the front wall, wherein the bottom wall and the two side walls are formed of a one-piece, completely integral sheet of polyolefin;

b) a frame located outside of the inner receptacle;

c) an anchor block attached to the outer surface of the inner receptacle proximate the rear opening, the anchor block cooperating with the frame to fix the relative position of the inner receptacle within the frame;

d) a door connected to the frame proximate the rear opening of the container, the door being movable between open and closed positions, wherein in the closed position, the door forms a rear wall of the container;

e) a seal located about the perimeter of the rear opening formed by the inner receptacle;

f) top corner fittings located on each of the upper corners of the frame; and g) bottom corner fittings located on each of the lower corners of the frame.

18. An intermodal container according to claim 17, wherein the polyolefin is high molecular weight polyethylene.

19. An intermodal container according to claim 17, wherein the seal comprises a channel formed integral with the inner receptacle, the channel containing a gasket.

20. An intermodal container according to claim 19, wherein the door comprises a protrusion adapted to seal against the gasket.

* * * * *